US011685491B2

(12) United States Patent
Shen et al.

(10) Patent No.: US 11,685,491 B2
(45) Date of Patent: Jun. 27, 2023

(54) HETERO-STIFFNESS ROBOTIC DEVICE

(71) Applicant: City University of Hong Kong, Hong Kong (HK)

(72) Inventors: Yajing Shen, Hong Kong (HK); Jiahai Shi, Hong Kong (HK); Panbing Wang, Hong Kong (HK); Xiong Yang, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 56 days.

(21) Appl. No.: 17/518,579

(22) Filed: Nov. 3, 2021

(65) Prior Publication Data

US 2022/0169351 A1 Jun. 2, 2022

Related U.S. Application Data

(60) Provisional application No. 63/119,810, filed on Dec. 1, 2020.

(51) Int. Cl.

| | |
|---|---|
| ***B63H 1/14*** | (2006.01) |
| ***B63H 5/07*** | (2006.01) |
| *B63H 1/12* | (2006.01) |

(52) U.S. Cl.

CPC ..... *B63H 1/14* (2013.01); *B63H 5/07* (2013.01); *B63H 2001/125* (2013.01)

(58) Field of Classification Search

CPC ..... B63H 1/14; B63H 5/07; B63H 2001/125; B36H 1/30; B36H 1/36

USPC ..... 416/87; 440/14

See application file for complete search history.

(56) References Cited

U.S. PATENT DOCUMENTS

| | | | | |
|---|---|---|---|---|
| 1,987,582 | A * | 1/1935 | Terrell | D01H 11/006 15/354 |
| 4,483,268 | A * | 11/1984 | Pichl | B63B 5/24 114/65 R |
| 5,403,216 | A * | 4/1995 | Salmi | B63J 2/12 440/6 |
| 6,485,339 | B1 * | 11/2002 | Hartig | H02K 3/24 310/87 |
| 7,018,249 | B2 * | 3/2006 | Ries | B63H 5/125 62/51.1 |

(Continued)

*Primary Examiner* — Logan M Kraft
*Assistant Examiner* — John D Bailey
(74) *Attorney, Agent, or Firm* — Idea Intellectual Limited; Margaret A. Burke; Sam T. Yip

(57) ABSTRACT

The present invention provides a hetero-stiffness robotic device with a central body portion having a head end and a tail end. A rigid rotatable head propeller extends from the head end while a flexible rotatable tail propeller extends from the tail end. A head motor positioned in the central body portion rotates the rigid rotatable head propeller and a tail motor positioned in the central body portion rotates the flexible rotatable tail propeller. A controller independently controls a rotational speed of the head motor and the tail motor. The head and tail propellers may have helical shapes. The hetero-stiffness propulsion gives the robotic device a high level of environmental adaptivity over a wide range of viscosities. The device demonstrates advantages in linearity, straightness, bi-directional locomotion ability, and efficiency, which provides a critical competence for moving in low Reynolds number environments.

19 Claims, 11 Drawing Sheets

(56) References Cited

U.S. PATENT DOCUMENTS

| | | | | |
|---|---|---|---|---|
| 7,029,339 | B2 * | 4/2006 | Brach | H02K 55/04 310/87 |
| 10,669,008 | B2 * | 6/2020 | Fisher | H02K 9/227 |
| 10,940,928 | B2 * | 3/2021 | He | B63H 20/14 |
| 2004/0248479 | A1 * | 12/2004 | Hein | H02K 1/30 440/6 |
| 2011/0165802 | A1 * | 7/2011 | Danov | B63H 1/14 440/6 |
| 2014/0161615 | A1 * | 6/2014 | Hayman | B63H 1/26 416/170 R |
| 2018/0346107 | A1 * | 12/2018 | Brunner | B64C 27/025 |
| 2020/0010162 | A1 * | 1/2020 | Aoki | B63H 1/16 |

* cited by examiner

HETERO-STIFFNESS ROBOTIC DEVICE

FIELD OF THE INVENTION

The invention relates to a robotic device, and, more particularly to a hetero-stiffness propelled robotic device with adaptive energy allocation.

BACKGROUND

The aquatic environment is a large portion of the earth's surface and exploration of aqueous settings is extremely important. Due to adverse or dangerous conditions in aquatic environments, humans are unable to readily gain access; consequently, machine exploration becomes a necessary alternative. However, during exploration of aquatic environments such as the investigation of coastal tidal flats, the viscosity of the surroundings may be highly variable. The wide range of viscosities requires environmental adaptivity for movable machines during aquatic investigation. Currently, the motion of machines in highly viscous environments such as muddy regions in tidal flats is inadequate to meet the challenge of the high resistance posed by these environments.

Thus, there is a need in the art for improved devices that can achieve locomotion in a wide range of challenging environments. Such devices could be used for investigations of regions having different resistances to motion of exploratory machines.

SUMMARY OF THE INVENTION

The present invention was inspired by the structure of Ray sperm (FIG. 1B), which contains two helical sections: a rigid spiral forepart and soft helical tail end. The rigid spiral forepart is more efficient in a viscous environment, while the tail end moves more efficiently in a more dilute, les viscous environment. The robotic device of the invention exhibits adaptive propulsion with energy allocation: the device can change its energy distribution for the two helical sections (rigid spiral forepart and soft helical tail) according to the environmental viscosity. Consequently, the rotational speeds of each section change to realize high energy efficiency. During propulsion, both helical sections rotate in 3D and propel the entire device. Due to the adaptive rotational motions of the two helical sections, the machine demonstrates high environmental adaptivity. According to the test results, the hetero-stiffness helical propulsion machine can achieve excellent performance in environments with viscosities ranging from low to high. Further, each helical section can rotate both in a clockwise and a counterclockwise direction, providing bidirectional motion to the device.

Hence, this hetero-stiffness helical propulsion endows the machine with high environmental adaptivity over a wide range of viscosities. Furthermore, benefiting from the hetero-stiffness helical propulsion, the device demonstrates advantages in linearity, straightness, bi-directional locomotion ability, and efficiency, which provides a critical competence for moving in low Reynolds number environments.

In one aspect, the present invention provides a robotic device with a central body portion having a head end and a tail end. A rigid rotatable head propeller extends from the head end while a flexible rotatable tail propeller extends from the tail end. A head motor positioned in the central body portion rotates the rigid rotatable head propeller and a tail motor positioned in the central body portion rotates the flexible rotatable tail propeller. A controller independently controls a rotational speed of the head motor and the tail motor. The head and tail propellers may have helical shapes.

BRIEF DESCRIPTION OF THE DRAWINGS

FIG. 3A shows image sequences. FIG. 3B shows rotational speeds. FIG. 3C shows the forward speed ratio. The device is driven by a single spiral head or a single helical tail in various solutions with the same power input. In the viscous solution, the device driven by a single head moves faster and the energy efficiency is higher. In comparison, the device driven by the single tail performs better in the dilute solution.

FIGS. 4A-4B shows images of the motion under different conditions while FIG. 4C is a plot of velocity vs. viscosity.

FIG. 5A is image sequences, FIG. 5B shows the backward velocity as a function of viscosity and FIG. 5C shows the rotational speed of the head as a function of viscosity.

DETAILED DESCRIPTION

Figure 1A:
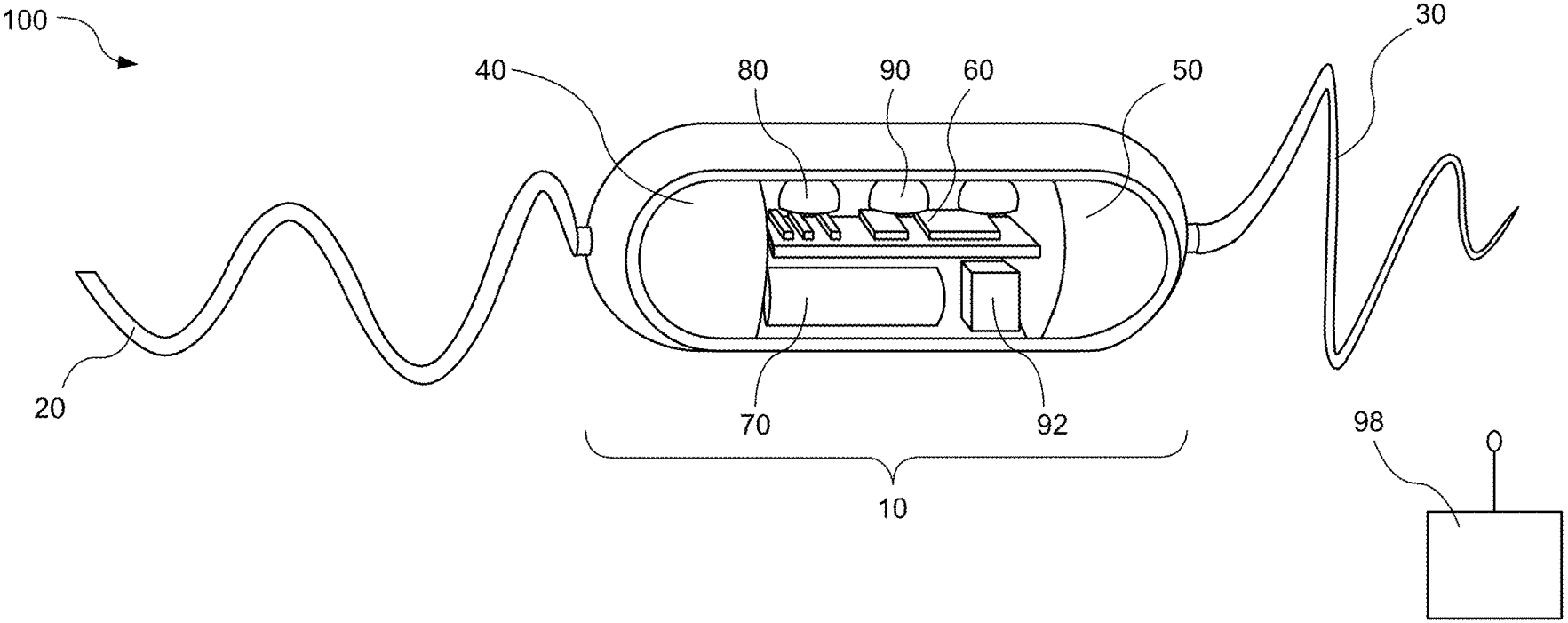
FIG. 1A is a schematic view of the hetero-stiffness helical propulsion device according to an embodiment.

Turning to the drawings in detail, FIG. 1A schematically depicts a robotic device 100 according to an embodiment. Robotic device 100 includes a central section 10. Extending from the front of central section 10 is rigid head propeller 20; extending from the rear of the central section 10 is a flexible tail propeller 30. The robotic device achieves locomotion using either or both of the rigid head propeller 20 and the flexible tail propeller 30. The rigid head propeller 20 is independently driven by head motor 40 while the flexible tail propeller is independently driven by tail motor 50. Exemplary motors are selected from rotary motion motors such as a 4×8 mm DC motor (commercially available from Shenzhen Jiechuangsen Technology Co., Ltd). The movement of the head 20 and/or the tail 30 propellers may be bidirectional; that is, rotation in one direction may propel the robotic device 100 in a forward direction and rotation in an opposite direction may propel the robotic device in the reverse direction.

Within the central section 10, a controller 60 is provided to control the head motor 40 and the tail motor 50. The controller 60 and motors 40 and 50 are powered by a power supply 70 which may be a rechargeable or single use battery. The controller 60 cooperates with one or more sensors 80 to sense the viscosity of the external environment and select whether the rigid head propeller 20 or the flexible tail propeller 30 should dominate the propulsion of the robotic device. The controller further determines the rotational speed and direction (clockwise or counterclockwise) of the rigid head 20 and the flexible tail 30. In this manner, the controller 60 allocates energy being supplied between the head propeller and the tail propeller so as to adaptively driving the robotic device 100 to locomote in a medium according to a viscosity of the medium.

Figure 1B:
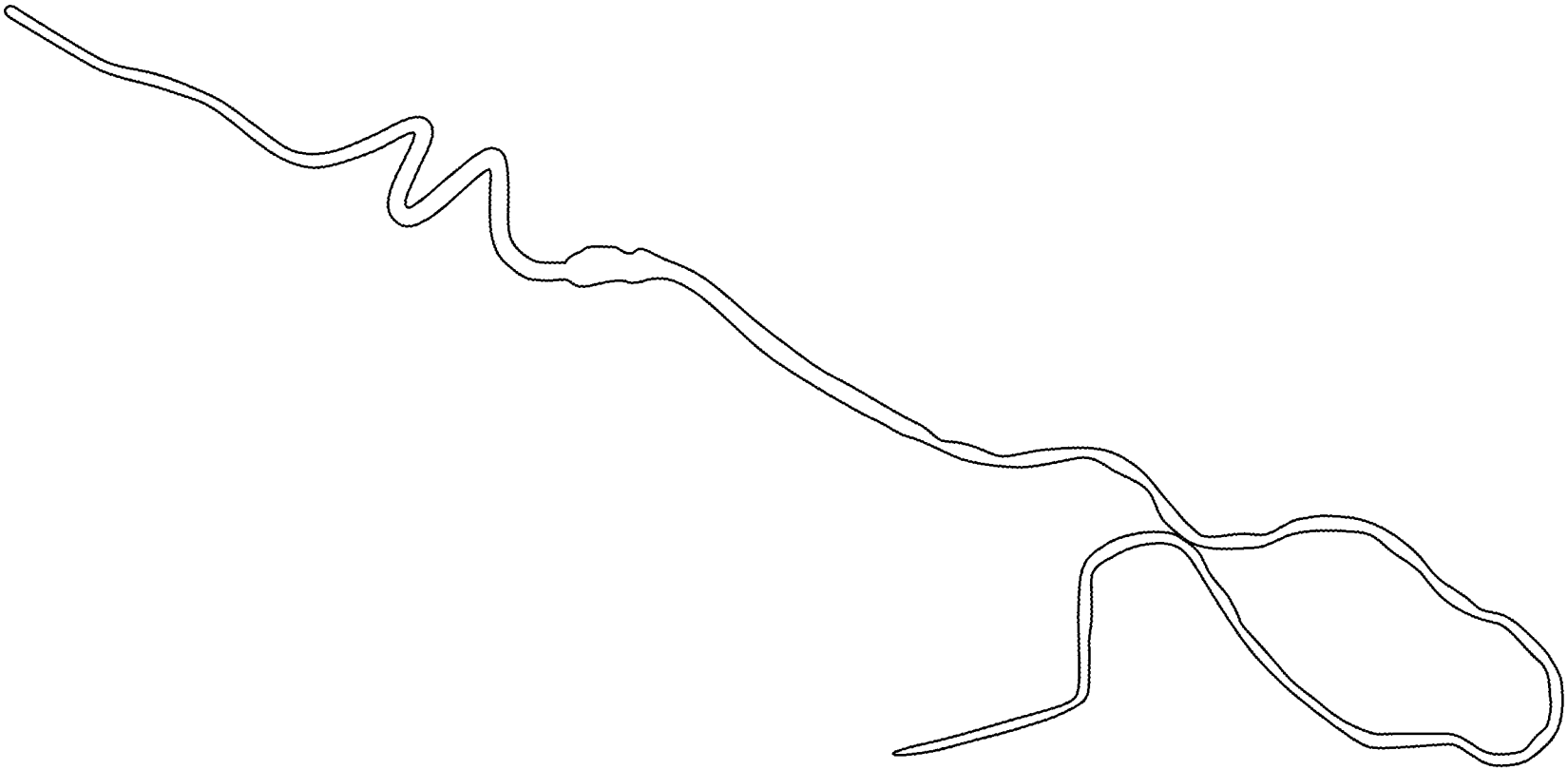
FIG. 1B is a photograph of a Ray sperm.

In one aspect, the rigid head propeller 20 may have a curved shape; in the embodiment of FIG. 1, a helical curved shape is selected. Similarly, the flexible tail propeller 30 may have a curved shape with FIG. 1 depicting a helical shape. However, the shape of the head propeller 20 and/or tail propeller 30 may be a curved shape other than a helix; any curved shape that can propel the overall robotic device 100 may be selected.

Optionally, the rigid head propeller 20 element has a different diameter from flexible tail propeller 30; the diameter and pitch of the helix may also be different. In an embodiment, the head propeller element 20 has a diameter on the order of 200-300 microns while the flexible tail 30 may have a diameter on the order of 1-3 mm. The rigid head propeller 20 element may be made from a metal wire such as iron, steel, stainless steel, copper, or aluminum curved into a shape such as the helix of FIG. 1; the flexible tail propeller 30 may be made from a flexible natural or synthetic fiber such as cotton or nylon, coated with a flexible polymer. In one aspect, the flexible polymer may be a polysiloxane such as polydimethylsiloxane. When the rigid head propeller is a helix, the diameter of the helix may be on the order of 0.5 mm to 1.5 mm. When the flexible tail propeller is a helix, the diameter of the helix may be on the order of 2.0 mm to 3.0 mm. It is understood that these dimensions are exemplary; other dimensions may be selected based on the size and weight of the central section 10 and the selected purpose and/or environment of use of the robotic device.

The orientation of the rigid head propeller 20 and the flexible tail propeller 30 may be independently selected. As seen in FIG. 1, the axis of the head helix is approximately parallel to a longitudinal axis of the central section 10. However, in other embodiments, either the head 20 or tail 30 may have an axis that forms an angle with respect to the longitudinal axis of the central section 10. For example, the tail propeller 30 may be oriented oblique with respect to a rotational axis of the tail propeller. In this manner, turning of the robotic device 100 may also be achieved, in addition to the forward and reverse motion.

The controller 60 may further include a wireless communication module that cooperates with a remote controller 98. Through the use of a camera sensor 90 whose images may be fed remotely to a user, the user may select to control a direction of the robotic device by selecting to turn the device in a particular direction or advance or reverse the progress of the device using remote control 98.

Other sensors 90 may be included to analyze the external environment according to the exploration mission of the robotic device 100. For example, sensors may be included that take water quality samples, storing the data in data storage area 92. One or more cameras may also be included as sensor 90, with images stored in data storage area 92. Other sensors include pH sensors, ammonia nitrogen ion sensors, turbidity sensors, conductivity sensors, or dissolved oxygen sensors. It is understood that any sensors that can be carried by central section 10 may be used in the robotic device 100 of the present invention.

Advantageously, the robotic device 100 may be made in a miniature size range. for example, the central section 10 may range in length from approximately 15 mm to approximately 20 mm with a diameter (for an approximately cylindrical central section 10) in a range of approximately 3-6 mm with 4 mm being an exemplary value. The length of the rigid head 20 and the flexible tail 30 may be in a range from 10 mm to 15 mm. This permits the robotic device 100 to be able to explore regions that conventional manned vehicles or conventional robots are unable to access.

In other aspects, for example, applications within a living organism, the robotic device 100 may be further miniaturized to have a central section 10 with a length of less than 4 mm with head and tail portions an additional 8 mm or less.

Examples

1. Fabrication of the Robotic Device and Experimental Overview

The robotic device of FIG. 1 is fabricated using two independent motors with a size of 4 mm×8 mm, a rated power of 1.5 V×0.041 A (commercially available from Shenzhen Jiechuangsen Technology Co. Ltd.), and a maximum rotational frequency of 120 Hz. The rigid helix acting as the head propeller 20 was fabricated manually by wrapping an iron wire with 250 μm diameter on a mandrel. The pitch angle, radius, and axial length of the head helix was 45°, 0.8 mm, and 10 mm, respectively. The tail helix was manufactured by coating a polydimethylsiloxane (PDMS, 0.1 equivalent curing agents, Sylgard 184, Dow Corning) layer on a 1 mm diameter cotton wire. First, the cotton wire was soaked in the PDMS solution for full integration, then wrapped around a mandrel with a radius of 2.7 mm and finally thermal cured in 70° C. for 24 hours. The cured PDMS made the tail helixes can be deformed by force while maintaining a certain spiral shape in a normal state. The made tail helix had an axial length of 25 mm with a pitch angle of 45°. The further test results indicated that Young's modulus of head and tail material is $1.2\times10^{11}$ N/m$^2$ and $2.51\times10^{7}$ N/m$^2$, respectively. The rigid head helix was aligned to the motor axis exactly, while the oblique angle between the long axis of the flexible tail helix and the motor axis was 5° to express the large swing of the Ray sperm's tail.

This device was placed in a rectangular container (200 mm×75 mm×35 mm) filled dimethyl silicone oil (Density 0.9630, Aladdin Chemistry Co. Ltd.) with the viscosity changing from 100 mPa·s to 1600 mPa·s at 25° C. The power for motors was provided by two programmable DC power supplies (eTM-L303SP) with an accuracy of 0.0001 A and 0.001 V. The motions of the robotic device were captured by the KEYENCE VW-Z1 motion analyzing microscope with 500 fps.

2. Preliminary Testing Results of the Fabricated Robot Device

Figure 2:
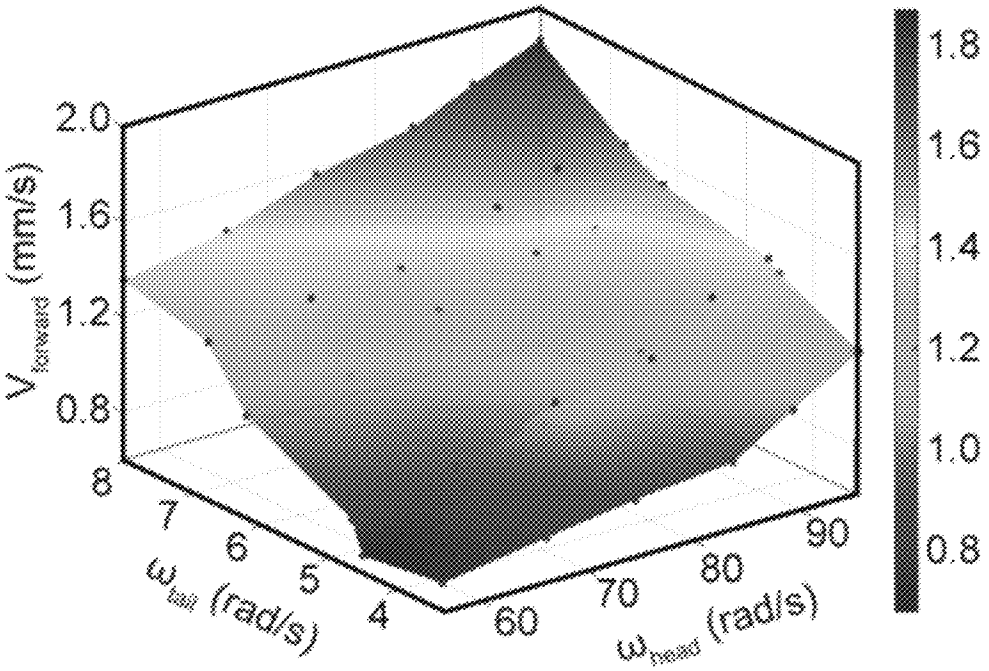
FIG. 2 is a fitting surface of the rotational speed of the head and tail sections, and the forward velocity.

1. Verification of the Relationship Between the Rotational Speeds and the Forward Velocity To investigate the relationship between the rotational speed of head propeller and tail propeller, as well as the velocity of the total robotic device, the device was placed in 800 mPa·s silicone oil, and the head propeller and tail propeller were each driven by two independent motors with the power ranging from 0.025 W to 0.05 W. As shown in FIG. 2, the rotational speed of the head propeller from 8.9 to 15.2 rps, the rotational speed of tail changed from 0.5 to 1.2 rps, and the forward speed of the machine increased along with the two in the range of 0.7 to 1.8 mm/s.

2. Propulsive Contribution and Adaptivity of Each Section

Figure 3A:
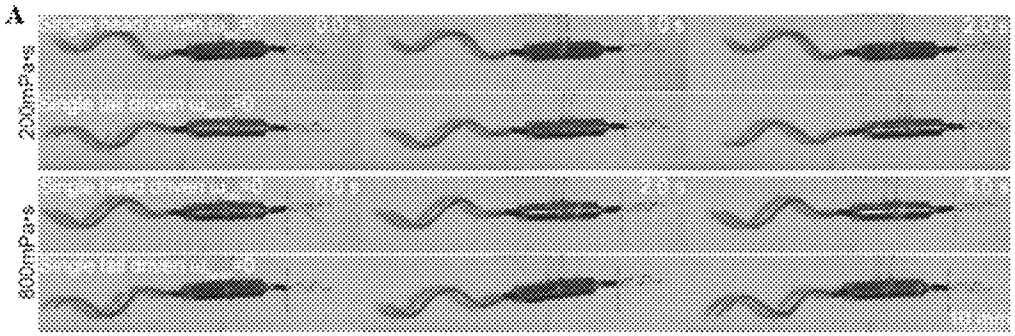
FIG. 3A-3C shows the motion of a hetero-stiffness helical propulsion device with a single drive under the same power.
Figure 3B:
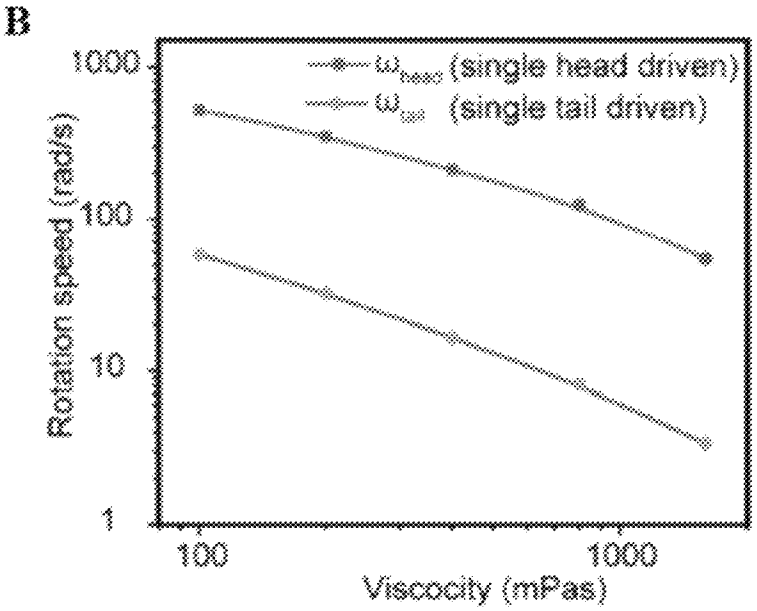
Figure 3C:
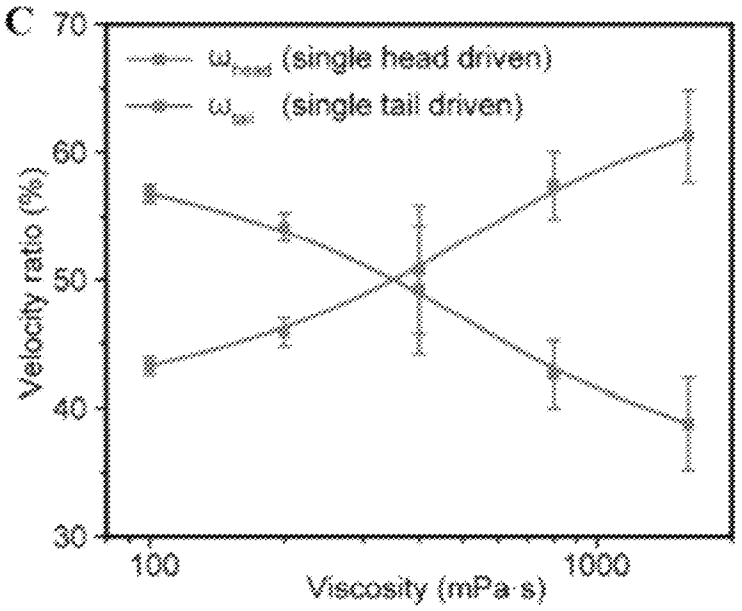

The analysis of the propulsive contribution of the helical head and tail in different viscous solutions was then conducted. The robotic device was driven by a single head or tail propeller with the power of 0.05 W in solutions with viscosities from 100 mPa·s to 1600 mPa·s (FIG. 3A). FIG. 3B indicates that the two rotational speeds decreased with an increase in viscosity, and the rotational speed of the tail dropped faster than that of the head. According to the velocity ratio in FIG. 3C, the device driven by the flexible helical tail moves faster in the dilute solution while the device driven by the rigid helical head performs better in the dilute solution. Since the device is driven with the same power input, the flexible helical tail end demonstrates higher energy efficiency in low viscosity solutions, and the rigid helical head is more efficient in high viscosity solutions. Hence, when the device is driven by both the rigid helical head and the flexible helical tail, it can adapt to a variety of environments with viscosities from low to high. This demonstrates the high environmental adaptivity of the robotic device of the present invention. Furthermore, the ratio of the forward speed in FIG. 3C also establishes the different energy efficiencies of the rigid helical head and the flexible helical tail. Therefore, the robotic device with hetero-stiffness helical propulsion can change its energy distribution between the two sections (front and rear) to adapt to the surrounding environment.

3. Motion Efficiency

To compare the robotic device's motion when driven by dual or single propellers, three types of devices were tested: a device with a helical head and helical tail, a device with a rigid helical head and a wound tail, and a device with a straight head and a flexible helical tail. During device propulsion, the two motors of each device were driven in series with the fixed total input power of 0.075 W. The three devices were tested in the same receptacle filled with silicone oil having viscosity ranging from 100 mPa·s to 1600 mPa·s.

Figures 4A, 4B:
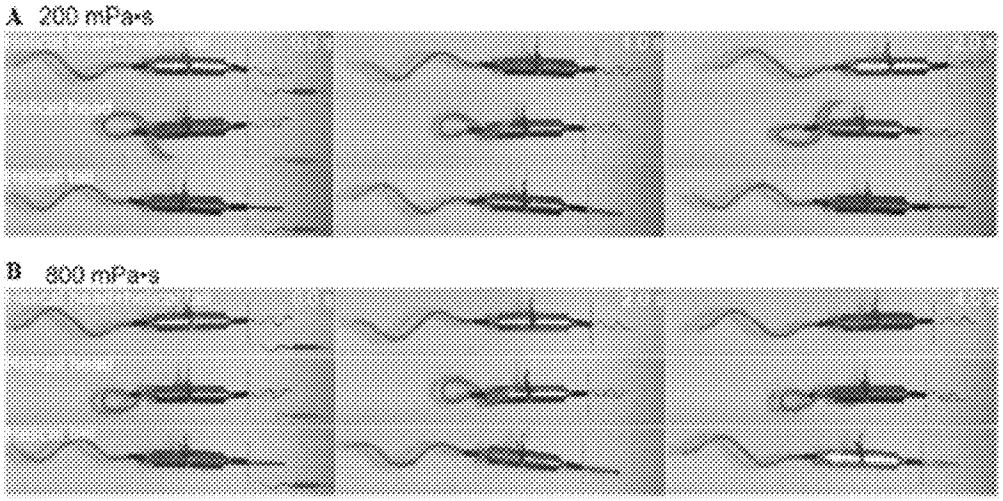
FIGS. 4A-4C show the motion of the device with dual or single helical structure under the same power.
Figure 4C:
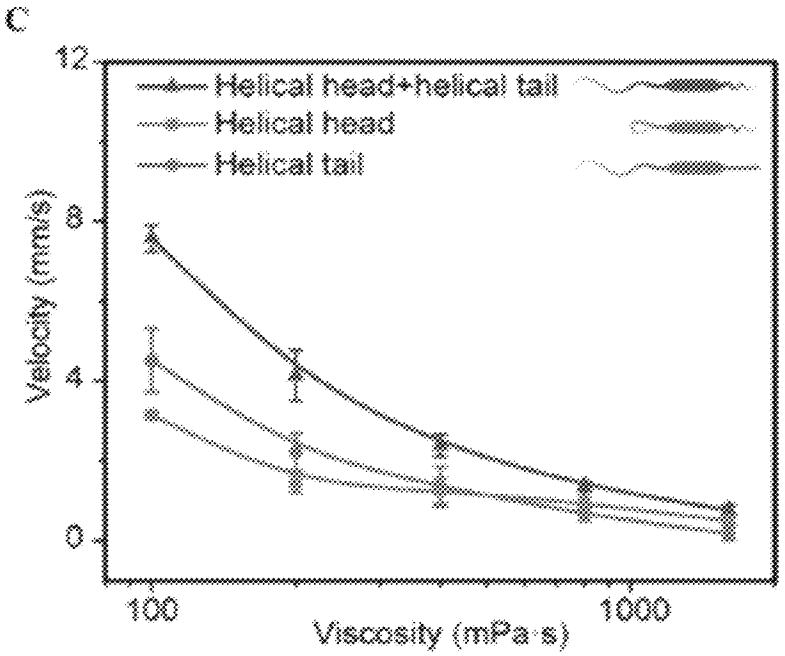

FIGS. 4A-B depict the image sequences of the three devices during motion. It is clear that the device with hetero-stiffness helical propulsion moves the fastest when compared with the other two devices with single propulsion. The detailed rotational speed and forward velocity of machines in various solutions are illustrated in FIG. 4C. Although the forward velocities all decrease with an increase in viscosity, the device with hetero-stiffness helical propulsion consistently performs the best in all solutions. Because each device used the same input power, the hetero-stiffness helical propulsion device of the present invention demonstrates the greatest energy efficiency.

4. Bi-Directional Motion Ability

Figure 5A:
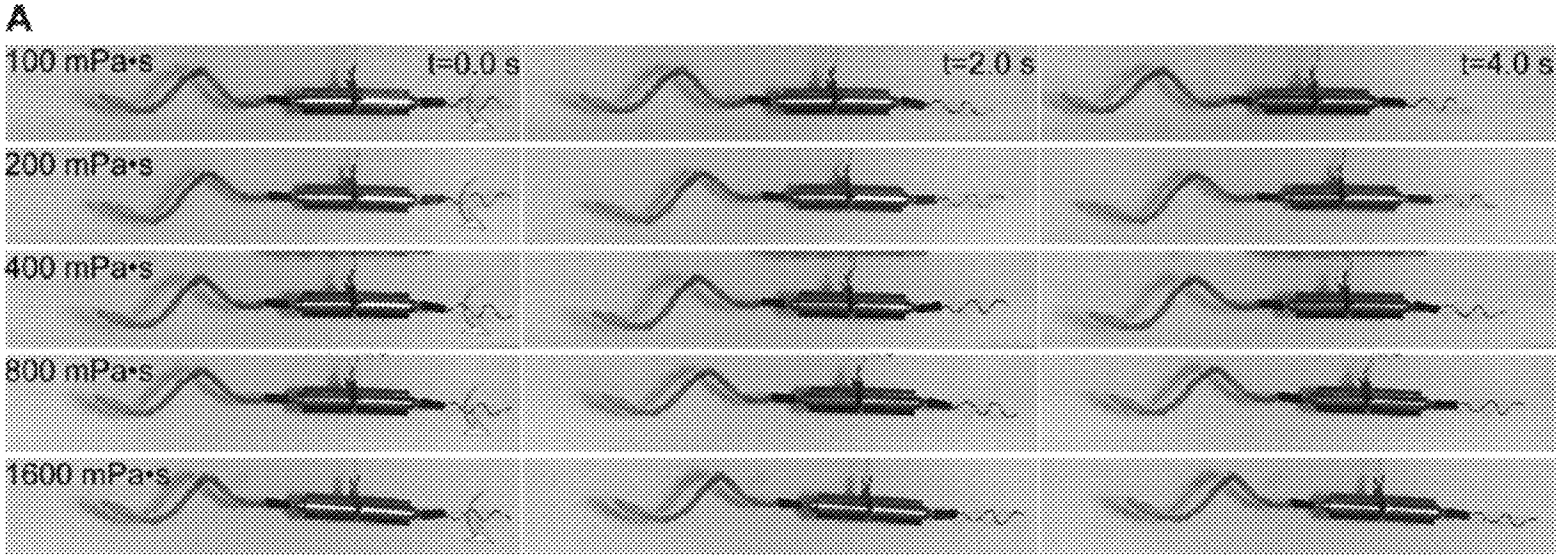
FIGS. 5A-5C show backward motion of the device.
Figure 5C:
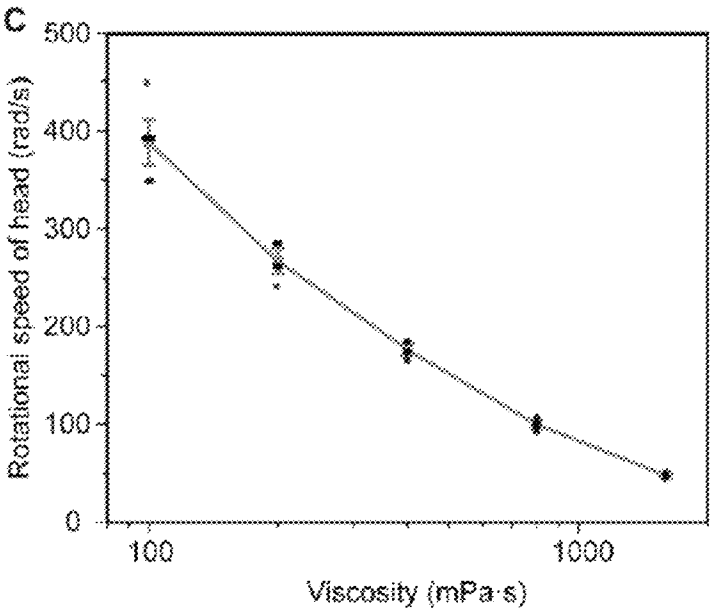
Figure 5B:
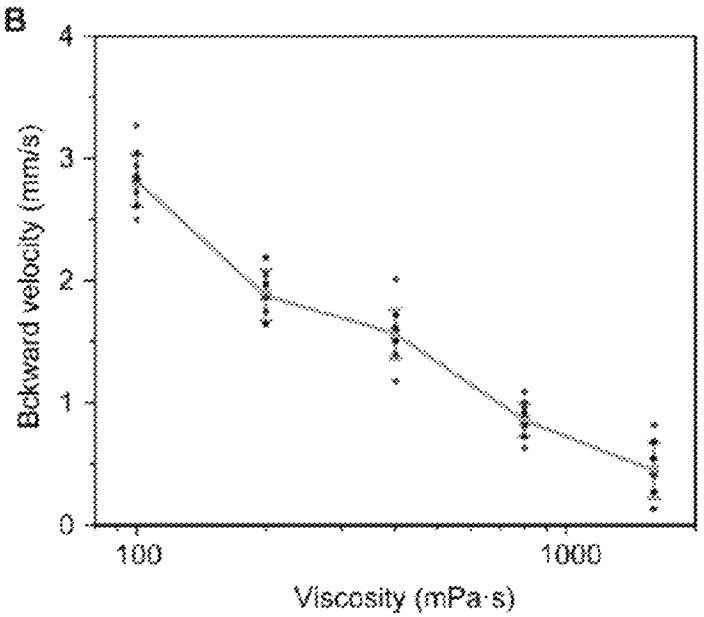

Apart from the forward motion illustrated above, the robotic device of the present invention can also exhibit backward motion. For conventional devices driven by a single propeller, backward motion is difficult to accomplish due to the softness of the propulsion part. However, the robotic device of the present invention having hetero-stiffness propulsion can move backward due to the existence of the rigid head propeller. As shown in FIG. 5, the device can move backward in various solutions. Owing to this ability, the device can evade encountered obstacles. Hence, the flexibility and motility of the hetero-stiffness device is significantly high.

5. The Dynamic Model of Dual Helical Driving Mode

Figure 6:
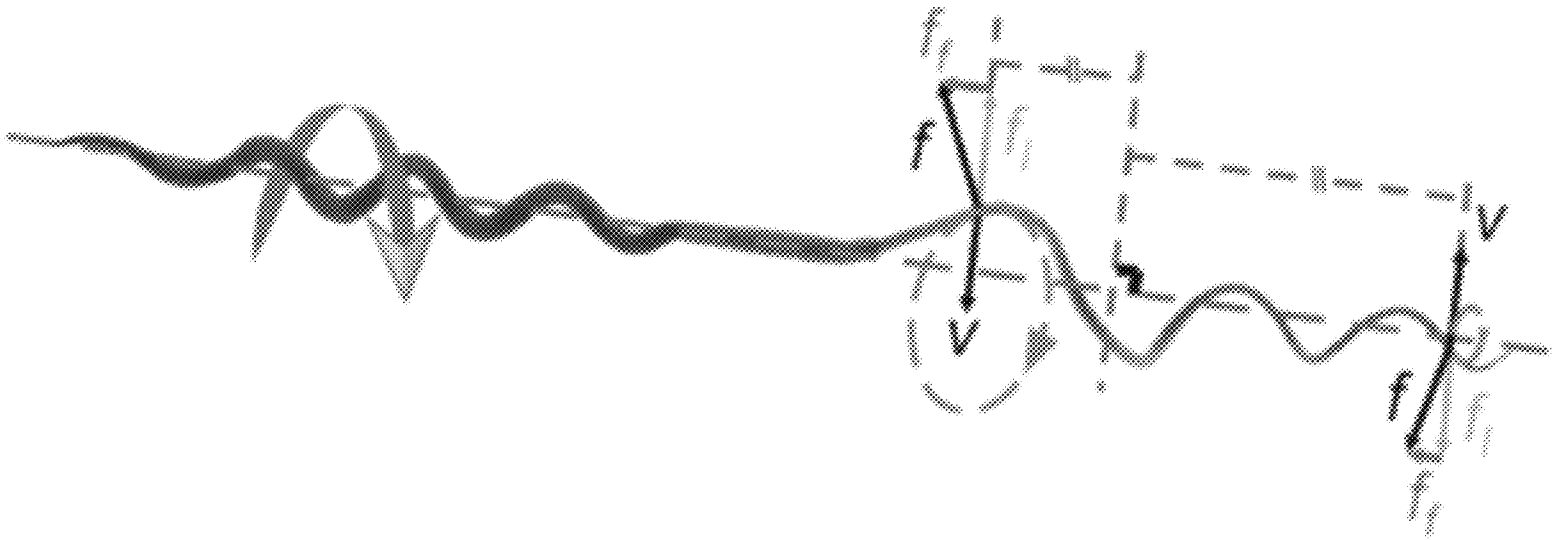
FIG. 6 is a model of the dual helical driving mode by resisting force theory.
Figure 7:
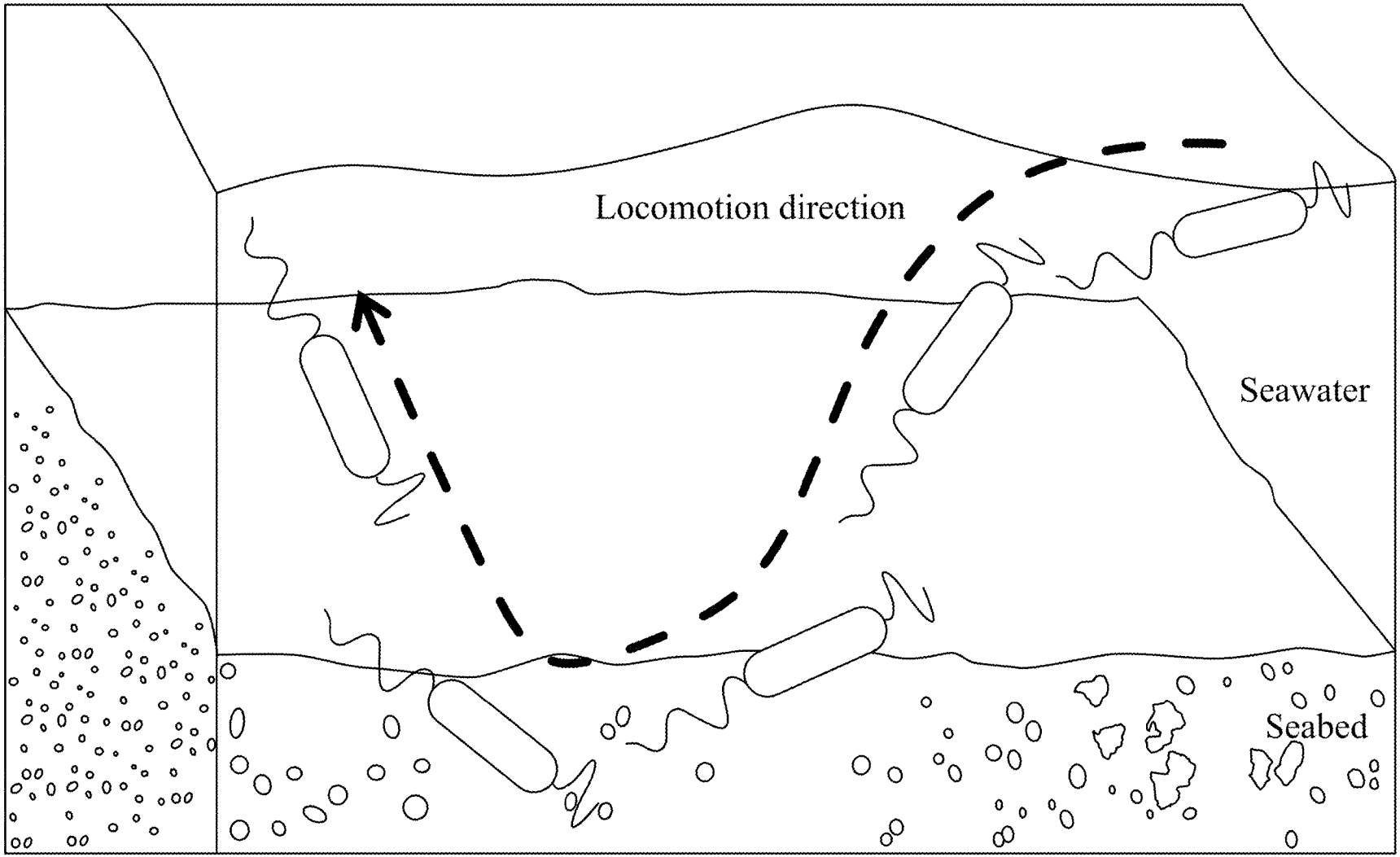
FIG. 7 is a schematic view of an application of the device of FIG. 1.

According to the resisting force theory, the propulsion force was analyzed by dividing the device into innumerable tiny parts, where each part generates a corresponding resistance and driving force depending on its size and shape. FIG. 6 shows the preliminary model of hetero-stiffness helical propulsion mode by resisting force theory. Where $v_n$ is the normal velocity, $v_t$ is the tangential velocity, $f_n$ and $f_t$ are the corresponding normal stress and tangential resisting force. Thus, the forward propulsive force can be obtained by $f_f=f_t \sin\varphi - f_n \cos\varphi$, where $\varphi$ is the helical leading angle. Here the central section can be modeled as a cylinder which only has resisting force in propulsion.

For a regular helix, its propulsive force can be calculated as:

$$F=\Omega RL(C_n-C_t)\sin\alpha$$

Where $\Omega$ is the rotation speed, R is the radius of helix structure, R is the axial length of helix, $C_n$ and $C_t$ are corresponding coefficients of resistance along normal and tangential direction which described by:

$$C_n = \frac{4\pi\mu}{\ln\left(\frac{2\lambda}{b}\right)+0.5}$$

$$C_t = \frac{2\pi\mu}{\ln\left(\frac{2\lambda}{b}\right)-0.5}$$

In which, $\mu$ is the dynamic viscosity of working fluid, $$\lambda = \frac{2\pi R}{\tan\alpha}$$

is the helical pitch, b is the radius of helical material. The propulsive force of the helical head or tail can be calculated by substituting the data into the above equations.

Industrial Applicability

Inspired by Ray sperm, a hetero-stiffness robotic device with adaptive energy allocation has been developed. The experimental results and dynamic model verified that the flexible helical tail has high efficiency in a low viscosity environment and the rigid helical head performs better in a high viscosity environment. The device having hetero-stiffness propulsion demonstrates high environmental adaptivity in a wide range of viscosities, adaptive energy allocation in various solutions, and high energy efficiency. In contrast to conventional driven approaches such as propellers and paddles that work well only in a low viscosity environment, the novel hetero-stiffness propulsion mode gives the device valuable motility and efficiency from normal water conditions to highly viscous mud or oil environments. Consequently, the fabricated hetero-stiffness propulsion device with adaptive energy allocation can be applied in diverse applications, such as environmental exploration in mud, oil, ocean, or sediment, and in biomedical engineering for disease diagnosis and drug delivery.

The hetero-stiffness propulsion robotic device with adaptive energy allocation demonstrates a novel propulsion mechanism, which provides a new approach for moving in an aquatic environment, especially in low Reynolds numbers. The device shows excellent locomotion performance in a range of viscosities from low to high. It can also move bi-directionally and turn around. Thus, it is suitable for the following applications:

1. Water environment exploration: In water environment exploration, such as the investigation of tidal flats and silts, the viscosity changes during locomotion. The device can adapt its propulsion as it changes environmental viscosity.

2. Biomedical engineering. The viscosities insides animal tissues change in organs, muscle, blood, etc. The robotic device of the present invention can be used as a medical robot for biomedical engineering tasks, such as drug delivery, and disease diagnosis.

Advantages

1. The robotic device can locomote both inside mud and water with adaptive propulsion and high energy efficiency.

2. The robotic device includes rigid head propeller and a flexible tail propeller. The rigid head performs better in high viscosity solutions while the flexible tail performs better in low viscosity solutions.

3. The robotic device can adaptively change the energy distribution between the head and the tail to increase locomotion efficiency.

4. Due to the adaptivity of the head and tail sections, the robotic device demonstrates high environmental adaptivity at a large viscosity range.

5. The robotic device can move bi-directionally and change direction when moving.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and the drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations.

The invention claimed is:

1. A hetero-stiffness robotic device comprising:

a central body portion having a head end and a tail end;

a rigid rotatable head propeller extending from the head end;

a flexible rotatable tail propeller extending from the tail end;

a head motor positioned in the central body portion mechanically communicating with the rigid rotatable head propeller for rotating the rigid rotatable head propeller;

a tail motor positioned in the central body portion mechanically communicating with the flexible rotatable tail propeller for rotating the flexible rotatable tail propeller;

a controller electrically communicating with the head motor and the tail motor for independently controller a rotational speed of the head motor and the tail motor.

2. The hetero-stiffness robotic device of claim 1, wherein the rigid rotatable head propeller has a helical shape having a first helix diameter and a first helix pitch.

3. The hetero-stiffness robotic device of claim 2, wherein the flexible rotatable tail propeller has a helical shape with a second helix diameter and a second helix pitch.

4. The hetero-stiffness robotic device of claim 3, wherein the first helix diameter is different from the second helix diameter.

5. The hetero-stiffness robotic device of claim 4, wherein the first helix diameter is smaller than the second helix diameter.

6. The hetero-stiffness robotic device of claim 1, wherein the flexible rotatable tail propeller comprises a helical filament.

7. The hetero-stiffness robotic device of claim 6, wherein the helical filament is a cotton filament coated with a polymer.

8. The hetero-stiffness robotic device of claim 7 wherein the polymer is a polysiloxane.

9. The hetero-stiffness robotic device of claim 1, wherein the head motor can rotate the rigid rotatable head propeller in a clockwise direction and in a counterclockwise direction.

10. The hetero-stiffness robotic device of claim 9, wherein the tail motor can rotate the flexible rotatable tail propeller in a clockwise direction and in a counterclockwise direction.

11. The hetero-stiffness robotic device of claim 10, wherein the controller controls the head motor and the tail motor to move the robotic device in a forward direction and in a reverse direction.

12. The hetero-stiffness robotic device of claim 6, wherein the helical filament is selected from a polymeric or natural fiber filament.

13. The hetero-stiffness robotic device of claim 1, wherein the rigid rotatable head propeller comprises a helical wire.

14. The hetero-stiffness robotic device of claim 13, wherein the helical wire is selected from iron, steel, copper, aluminum, or nickel wires or alloys thereof.

15. The hetero-stiffness robotic device of claim 1, further comprising one or more sensors positioned in the central body section.

16. The hetero-stiffness robotic device of claim 15, wherein the one or more sensors is selected from one or more of a camera, pH sensor, ammonia nitrogen ion sensor, turbidity sensor, conductivity sensor, or dissolved oxygen sensor.

17. The hetero-stiffness robotic device of claim 1, wherein the rigid rotatable head propeller has a central axis that is parallel to a longitudinal axis of the central body portion.

18. The hetero-stiffness robotic device of claim 1, wherein the flexible rotatable tail propeller has a central axis that forms an acute angle with respect to a longitudinal axis of the central body portion.

19. The hetero-stiffness robotic device of claim 1, wherein the controller includes a wireless communication module cooperating with a remote controller.

* * * * *